US011537153B2

(12) United States Patent
Cavallaro et al.

(10) Patent No.: US 11,537,153 B2
(45) Date of Patent: Dec. 27, 2022

(54) LOW POWER VOLTAGE REFERENCE CIRCUITS

(71) Applicant: STMicroelectronics S.r.l., Agrate Brianza (IT)

(72) Inventors: Marco Orazio Cavallaro, Catania (IT); Germano Nicollini, Piacenza (IT); Giuseppe Palmisano, S. Giovanni la Punta (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 625 days.

(21) Appl. No.: 16/459,169

(22) Filed: Jul. 1, 2019

(65) Prior Publication Data

US 2021/0004031 A1 Jan. 7, 2021

(51) Int. Cl.

| | |
|---|---|
| ***G05F 1/46*** | (2006.01) |
| ***G05F 1/59*** | (2006.01) |
| ***G05F 1/575*** | (2006.01) |
| *G05F 3/24* | (2006.01) |
| *G05F 3/30* | (2006.01) |

(52) U.S. Cl.

CPC ..... *G05F 1/462* (2013.01); *G05F 1/575* (2013.01); *G05F 1/59* (2013.01); *G05F 3/242* (2013.01); *G05F 3/30* (2013.01)

(58) Field of Classification Search

CPC . G05F 1/46; G05F 1/462; G05F 1/463; G05F 1/567; G05F 1/575; G05F 3/30; G05F 3/262; G05F 3/24; G05F 3/242

See application file for complete search history.

(56) References Cited

U.S. PATENT DOCUMENTS

| | | | |
|---|---|---|---|
| 5,512,817 | A | 4/1996 | Nagaraj |
| 6,281,743 | B1 | 8/2001 | Doyle |
| 6,529,066 | B1 | 3/2003 | Guenot et al. |
| 8,680,840 | B2 | 3/2014 | Iacob et al. |
| 9,218,016 | B2 | 12/2015 | Pan |

(Continued)

FOREIGN PATENT DOCUMENTS

CN 207051761 U * 2/2018

OTHER PUBLICATIONS

Parisi, Alessandro, et al. "An accurate 1-V threshold voltage reference for ultra-low power applications," Elsevier Microelectronics Journal, 63, Oct. 2017, 5 pages.

(Continued)

*Primary Examiner* — Thienvu V Tran
*Assistant Examiner* — Shahzeb K Ahmad
(74) *Attorney, Agent, or Firm* — Slater Matsil, LLP

(57) ABSTRACT

A voltage reference circuit includes a first circuit block configured to generate a proportional to absolute temperature current, the first circuit block comprising a current mirror amplifier, a second circuit block coupled to the first circuit block and configured to generated a complimentary to absolute temperature current, and a third circuit block coupled to both the first circuit block and the second circuit block. The second circuit block includes a multi-stage common-source amplifier. The third circuit block is configured to combine the proportional to absolute temperature current and the complimentary to absolute temperature current to generate a reference voltage at an output of the voltage reference circuit.

20 Claims, 8 Drawing Sheets

(56) References Cited

U.S. PATENT DOCUMENTS

| | | | | |
|---|---|---|---|---|
| 9,612,607 | B2 | 4/2017 | Kumar et al. | |
| 9,952,617 | B1 * | 4/2018 | Gupta | G05F 3/262 |
| 10,019,026 | B2 | 7/2018 | Ippolito et al. | |
| 10,222,817 | B1 * | 3/2019 | Deng | G05F 3/30 |
| 10,379,566 | B2 * | 8/2019 | Acar | G05F 3/267 |
| 10,838,448 | B1 * | 11/2020 | Yadala | G05F 3/26 |
| 2009/0051341 | A1 * | 2/2009 | Chang | G05F 3/30<br>323/313 |
| 2014/0091780 | A1 | 4/2014 | Hu et al. | |
| 2019/0072994 | A1 | 3/2019 | Ippolito et al. | |
| 2019/0101948 | A1 | 4/2019 | Eberlein | |
| 2020/0233445 | A1 * | 7/2020 | Mouret | G05F 1/462 |

OTHER PUBLICATIONS

Yin, Jun, et al. "A System-on-Chip EPC Gen-2 Passive UHF RFID Tag With Embedded Temperature Sensor," IEEE, Journal of Solid-State Circuits, vol. 45, No. 11, Nov. 11, 2010, 17 pages.

Banba, Hironori, et al. "A CMOS Bandgap Reference Circuit with Sub-1-V Operation," IEEE, Journal of Solid-State Circuits, vol. 34, No. May 5, 1999, 5 pages.

* cited by examiner

LOW POWER VOLTAGE REFERENCE CIRCUITS

TECHNICAL FIELD

The present invention relates generally to voltage reference circuits, and, in particular embodiments, to voltage reference circuits suitable for low power applications.

BACKGROUND

Modern electronic circuits for the consumer market, (e.g. for mobile and wearable devices in particular), require a continuous reduction of costs and power consumption. From the circuit design point of view, a possible approach may be to reduce complexity while providing a low voltage solution. Electronic circuits may include circuit blocks that fulfil specialty roles within a larger electronic circuit of an electronic device. One such circuit block is a reference circuit. A reference circuit produces an accurate reference parameter that is stable under fluctuations of an external influence (e.g. temperature).

The accuracy and the temperature coefficient of a reference circuit may be important performance parameters of the reference circuit. The accuracy of the reference circuit is the error on the expected value which is generally expressed as a percentage. The temperature coefficient of the reference circuit is the sensitivity of the reference parameter with respect to the temperature. The temperature coefficient is generally expressed in parts per million (ppm).

There exists in the art, several approaches that have been developed to implement voltage reference circuits with high accuracy and low temperature coefficient. One approach consists of exploiting a weighted combination of parameters that have inverse dependency with respect to temperature (i.e. opposite slope with respect to the temperature). The weights are chosen to have a flat temperature behavior. If only two parameters are considered, this approach is called first order compensation. The reference parameter output curve of a first order compensation voltage reference circuit with respect to temperature is parabolic and has negative concavity due to the opposing slopes of the two parameters. It is also possible to use many parameters with different slopes which may be referred to as higher order temperature compensation.

A conventional reference circuit 600 is illustrated in FIG. 6 and is disclosed in H. Banba, et al. "A CMOS bandgap reference circuit with sub-1-V operation", *IEEE J. Solid-State Circuits.* 34 p. 670674. May 1999.

Referring to FIG. 6, the conventional reference circuit 600 includes metal-oxide-semiconductor field-effect transistors (MOSFETs) $M_{61}$, $M_{62}$, and $M_{63}$ coupled to a supply voltage $V_{DD}$. As shown, $M_{61}$, $M_{62}$, and $M_{63}$ are each a P-channel MOSFET (pMOSFET). A pair of bipolar junction transistors (BJTs) $Q_{61}$ and $Q_{62}$ that have a ratio of $1:N_6$ are coupled to $M_{61}$, $M_{62}$, and an operational amplifier 604. The BJTs $Q_{61}$ and $Q_{62}$ are PNP BJTs as illustrated. Various resistors $R_{61}$, $R_{62}$, $R_{63}$, and $R_{64}$ are included to adjust magnitudes of currents within the conventional reference circuit 600 which produces a voltage reference output at an output node $V_{REF,6}$.

Another conventional reference circuit 700 is illustrated in FIG. 7 and is disclosed in J. Yin, et al. "A system-on-chip EPC gen-2 passive UHF RFID tag with embedded temperature sensor" *IEEE J. Solid-State Circuits.* 5, p. 24042420 November 2010.

Referring to FIG. 7, the conventional reference circuit 700 includes pMOSFETs $M_{73}$, $M_{74}$, and $M_{75}$ coupled to a supply voltage $V_{DD}$ and a pair of PNP BJTs $Q_{71}$ and $Q_{72}$ with a ratio of $1:N_7$ coupled to $M_{73}$ and $M_{74}$. Rather than an operational amplifier, the conventional reference circuit 700 utilizes an N-channel MOSFET (nMOSFET) $M_{76}$ coupled to a pair of pMOSFETs $M_{71}$ and $M_{72}$ that are also supplied by $V_{DD}$. Various resistors $R_{71}$, $R_{72}$, and $R_{73}$ are included to adjust magnitudes of currents within the conventional reference circuit 700 which produces a voltage reference output at an output node $V_{REF,7}$.

Still another conventional reference circuit 800 is illustrated in FIG. 8 and is disclosed in A. Parisi, A. Finocchiaro, G. Palmisano, "An accurate 1-V threshold voltage reference for ultra-low power applications", *Elsevier Microelectronics Journal,* 63, p. 155-159, 2017.

Referring to FIG. 8, the conventional reference circuit 800 includes pMOSFETs $M_{83}$, $M_{84}$, $M_{85}$, $M_{87}$, and $M_{88}$ coupled to a supply voltage $V_{DD}$ and a pair of nMOSFETs $M_{81}$ and $M_{82}$ with a ratio of $1:N_8$. The nMOSFETs $M_{81}$ and $M_{82}$ are coupled to $M_{83}$ and $M_{84}$. An operational amplifier 804 is also included that has a positive input coupled between $M_{82}$ and $M_{84}$, a negative input coupled to $M_{81}$ and $M_{83}$, and an output coupled to $M_{87}$. Various resistors $R_{81}$, $R_{82}$, and $R_{83}$ are included to adjust magnitudes of currents within the conventional reference circuit 800 which produces a voltage reference output at an output node $V_{REF,8}$.

SUMMARY

In accordance with an embodiment of the invention, a voltage reference circuit includes a first circuit block configured to generate a proportional to absolute temperature current, the first circuit block comprising a current mirror amplifier, a second circuit block coupled to the first circuit block and configured to generated a complimentary to absolute temperature current, and a third circuit block coupled to both the first circuit block and the second circuit block. The second circuit block includes a multi-stage common-source amplifier. The third circuit block is configured to combine the proportional to absolute temperature current and the complimentary to absolute temperature current to generate a reference voltage at an output of the voltage reference circuit.

In accordance with another embodiment, a voltage reference circuit includes a proportional to absolute temperature generation circuit configured to generate a proportional to absolute temperature current, a complimentary to absolute temperature generation circuit configured to generate a complimentary to absolute temperature current, and an output circuit configured to combine the proportional to absolute temperature current and the complimentary to absolute temperature current to generate a reference voltage at an output of the voltage reference circuit. The complimentary to absolute temperature generation circuit includes a first p-type field-effect transistor having a source terminal coupled to a voltage supply, a gate terminal coupled to a ground connection at a first node, and a drain terminal coupled to the proportional to absolute temperature generation circuit and the ground connection at a second node. The complimentary to absolute temperature generation circuit further includes a second p-type field-effect transistor having a source terminal coupled to the voltage supply, a gate terminal coupled to the proportional to absolute temperature generation circuit at a third node, and a drain terminal coupled to the ground connection at the first node.

In accordance with still another embodiment of the invention, a voltage reference circuit includes a current mirror circuit, a PTAT generation circuit, a CTAT generation circuit, and an output circuit. The current mirror circuit is coupled to a voltage supply. The PTAT generation circuit is coupled to the current mirror circuit and to a ground connection. The CTAT generation circuit is coupled to the voltage supply, the current mirror circuit, the PTAT generation circuit, and the ground connection. The output circuit is coupled to the voltage supply, the current mirror circuit, the CTAT generation circuit, and the ground connection. All active devices in the voltage reference circuit are field-effect transistors. The voltage reference circuit does not include any operational amplifiers.

BRIEF DESCRIPTION OF THE DRAWINGS

For a more complete understanding of the present invention, and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the embodiments and are not necessarily drawn to scale. The edges of features drawn in the figures do not necessarily indicate the termination of the extent of the feature.

DETAILED DESCRIPTION OF ILLUSTRATIVE EMBODIMENTS

The making and using of various embodiments are discussed in detail below. It should be appreciated, however, that the various embodiments described herein are applicable in a wide variety of specific contexts. The specific embodiments discussed are merely illustrative of specific ways to make and use various embodiments, and should not be construed in a limited scope.

Reference circuits such as voltage reference circuits may be considered the power management core block of an integrated circuit. Furthermore, the reference parameters provided by reference circuits are important in sensors (e.g. in micro-electro-mechanical systems, referred to as MEMS). A sensor transduces a physical quantity into an electrical parameter (e.g. voltage or current) and evaluates the magnitude of the physical quantity by comparison with a reference parameter.

First order temperature compensation of voltage reference circuits may be implemented by combining a parameter that is proportional to absolute temperature (PTAT) and a parameter that is complimentary (i.e. inversely proportional) to absolute temperature (CTAT). The base-emitter voltage of a bipolar junction transistor and the gate-source voltage of a sub-threshold metal-oxide-semiconductor field-effect transistor (MOSFET) may exhibit a CTAT-like behavior. Furthermore, their exponential characteristics may be easily translated into a PTAT-like current using a Widlar-like current mirror. For these reasons these may be considered primary blocks for circuit implementations of a voltage reference or a current reference.

In order to clearly enumerate various advantages of the embodiment circuits described herein, an accurate analysis of various conventional reference circuits is provided below. The inventors have identified various disadvantages of conventional reference circuits as detailed below.

Figure 6:
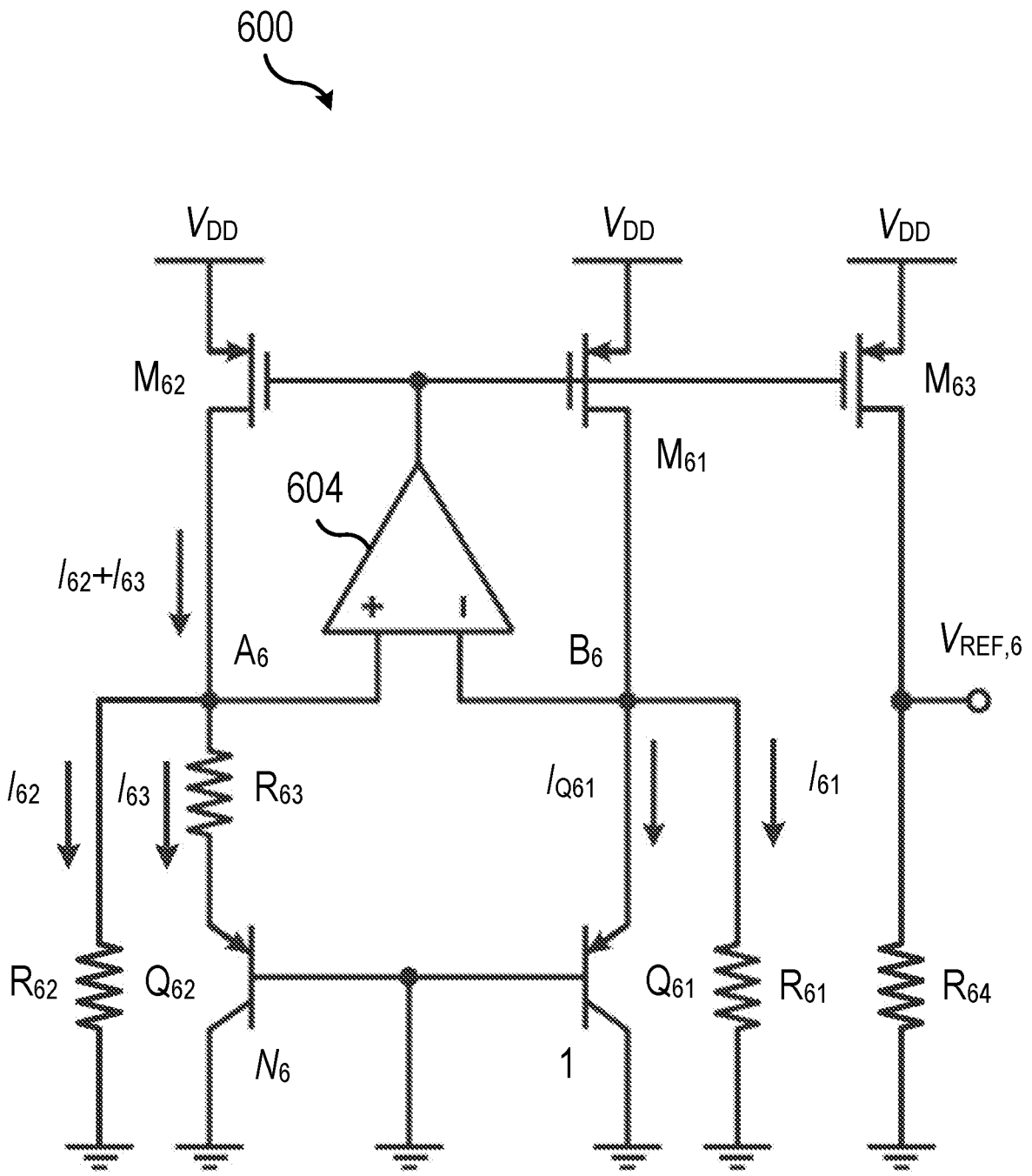
FIG. 6 Prior Art
FIG. 6 illustrates a conventional reference circuit.

A voltage reference such as the conventional reference circuit 600 may be implemented using complementary metal-oxide-semiconductor (CMOS) technology for use in low voltage applications as shown in FIG. 6. This circuit uses the same value of resistance for the resistors $R_{61}$ and $R_{62}$. The operational amplifier 604 forces the same voltage to nodes $A_6$ and $B_6$. Consequently, the currents $I_{61}$, $I_{62}$, and $I_{63}$ become the same due to the current mirror $M_{61}$-$M_{62}$. Then, exploiting the bipolar transistor equation and the pseudo-Widlar current mirror, the output voltage $V_{REF,6}$ is:

$$V_{REF,6} = \frac{R_{64}}{R_{61}} V_{EB61} + \frac{R_{64}}{R_{63}} V_T \ln(N_6) \tag{1}$$

As may be expected, the output voltage is sum of a CTAT term that includes the emitter-base voltage of $Q_{61}$ ($V_{EB61}$) and a PTAT term that includes the thermal voltage ($V_T$) which is equal to the Boltzmann constant multiplied by the temperature divided by the charge of an electron $$\left(\frac{kT}{q}\right).$$

The slope of the two terms can be tuned by the resistance ratio $R_{64}/R_{61}$ and $R_{64}/R_{63}$. This solution, based on the parasitic bipolar transistors $Q_{61}$ and $Q_{62}$, may provide robustness with respect to the process variation. However, the low forward common-emitter current gain $\beta_F$ of the parasitic transistors disadvantageously reduces the reference accuracy due to the non-negligible base current. Additionally, the offset voltage of the operational amplifier 604 also negatively impacts the reference accuracy of the conventional reference circuit 600 of FIG. 6.

Figure 7:
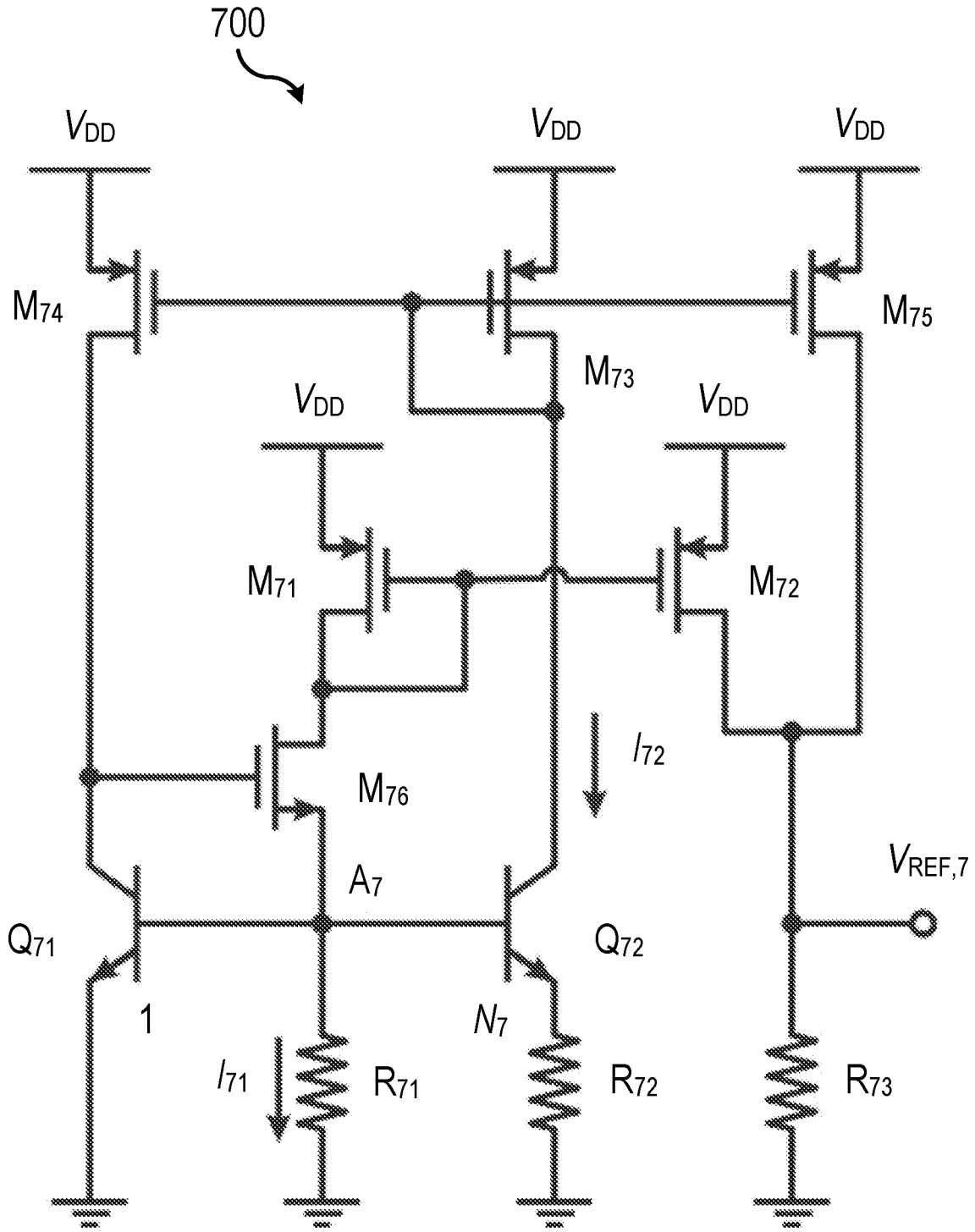
FIG. 7 Prior Art
FIG. 7 illustrates another conventional reference circuit.

A current mode voltage reference with a self-biased topology such as the conventional reference circuit 700 can be used to overcome to the offset limitation of an operational amplifier as shown in FIG. 7. This circuit is based on a Widlar circuit producing a PTAT current $I_{72}$. Again exploiting the bipolar transistor characteristic, $$I_{72} = \frac{V_{BE71} - V_{BE72}}{R_{72}} = \frac{V_T}{R_{72}} \ln(N_7) \tag{2}$$

Transistor $M_{76}$ is used for the current-recovery Widlar mirror and also produces the current $I_{71}$. The current $I_{71}$ has a CTAT behavior. Indeed, $$I_{71} = \frac{V_{BE71}}{R_{71}} \tag{3}$$

The current $I_{71}$ is reported at the output and added to the current $I_{72}$ by the $M_{71}$-$M_{72}$ current mirror. Then, the total current is converted to a voltage by $R_{73}$. i.e.

$$V_{REF,7} = \frac{R_{73}}{R_{71}} V_{EB71} + \frac{R_{73}}{R_{71}} V_T \ln(N_7) \tag{4}$$

This solution uses a self-biased topology and does not suffer from the operational amplifier offset. Furthermore, it offers good performance in terms of reference accuracy due to the low variability of bipolar junction transistors parameters with respect to the fabrication process. However, this solution disadvantageously requires an extra process mask for the NPN bipolar junction transistor $Q_{72}$. Additionally, the topology of the voltage reference circuit 700 is not compliant with low voltage applications and newer scaled technology which are also disadvantages.

Figure 8:
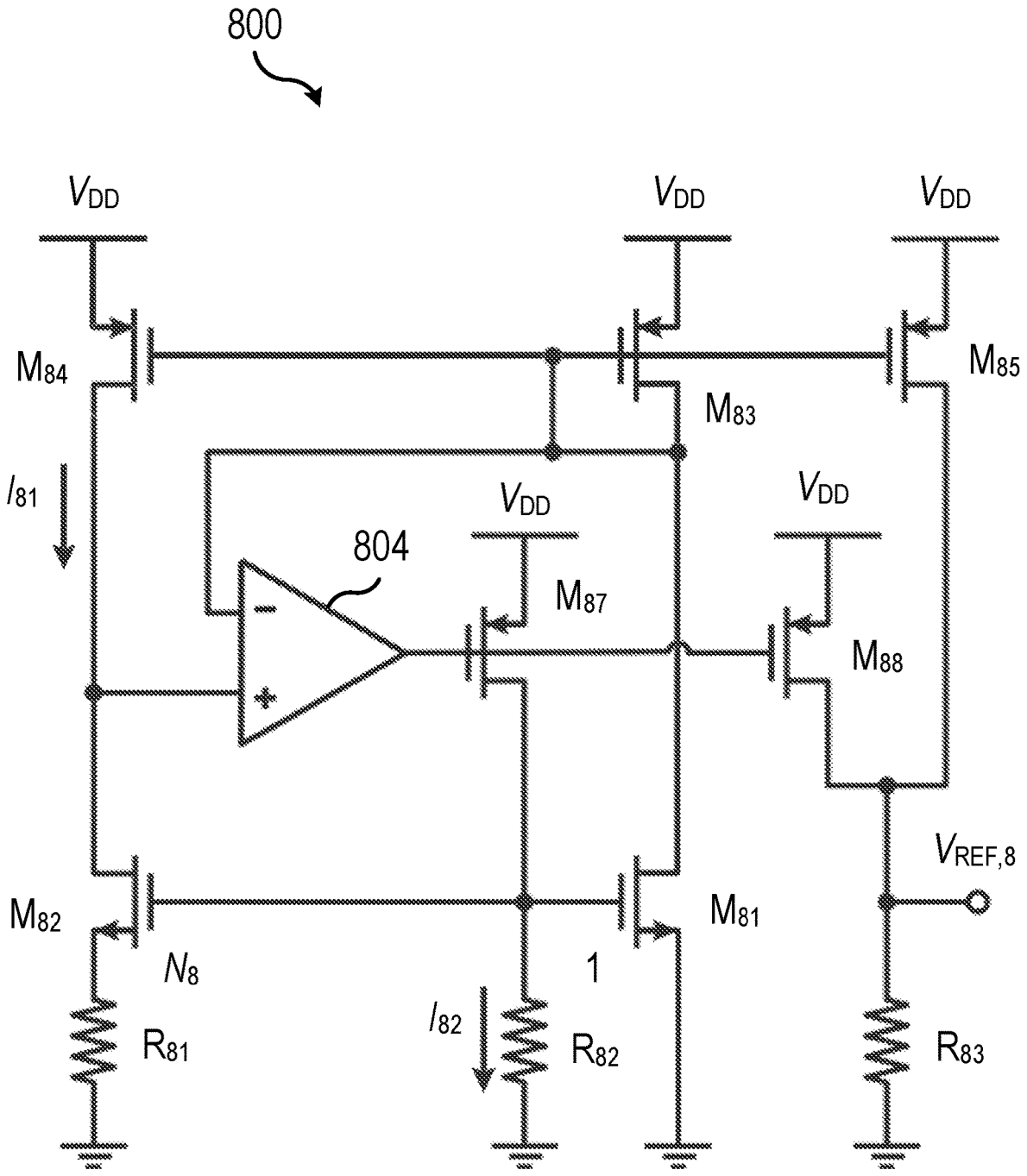
FIG. 8 Prior Art
FIG. 8 illustrates still another conventional reference circuit.

To eliminate the need for an extra process mask, sub-threshold MOSFETs may be used instead of bipolar junction transistors in a current-mode CMOS reference, such as in the conventional reference circuit 800 of FIG. 8. Furthermore, the topology is changed resulting in the transistor $M_{87}$ being in common-source topology rather than a common-drain topology (such as $M_{76}$ of FIG. 7, for example). This disadvantageously introduces increased complexity due to the operational amplifier 804. The sub-threshold MOSFETs offer characteristics similar to the bipolar junction transistors. In analogy to Eq. 2, the current $I_{81}$ can be expressed as $$I_{81} = \frac{V_{GS82} - V_{GS81}}{R_{81}} = \frac{V_T}{R_{81}} \ln(N_8) \tag{5}$$

The operational amplifier produces the bias voltage required to produce the current $I_{82}$ which is:

$$I_{82} = \frac{V_{GS82}}{R_{82}} \tag{6}$$

At a temperature range of [−40° C., 85° C.] for consumer applications the gate-source voltage may be considered to decrease linearly with temperature like the base-emitter voltage $V_{BE}$. Then, using MOSFET transistors it is possible to have a temperature compensated reference voltage written as $$V_{REF,8} = \frac{R_{83}}{R_{82}} V_{GS81} + \frac{R_{83}}{R_{81}} V_T \ln(N_8) \tag{7}$$

However, the performance spread of the MOSFET circuit is greater than the process spread offered by the bipolar junction transistors. As consequence, voltage references using MOSFETs such as the conventional reference circuit 800 have the disadvantage of reduced reference accuracy. Furthermore, the higher complexity and stability problems negatively impact power supply and start-up time.

Various circuits, as described herein, pertain to voltage reference circuits for ultra-low power and low voltage applications. For example, embodiment voltage reference circuits may be suitable for battery-less systems. The embodiments described in the following incorporate a feedback approach which provides a benefit of accurately setting the circuit biasing of a voltage reference based on PTAT and CTAT currents. The embodiment voltage reference circuits described herein preserve various advantages of conventional reference circuits such as low voltage, low power, accuracy and low cost, while advantageously overcoming drawbacks of conventional reference circuits such as stability problems and reduced start-up time.

Embodiments provided below described various voltage reference circuits, and in particular, voltage reference circuits suitable for low power applications. The following description describes the embodiments. An embodiment voltage reference circuit is described using a schematic circuit block diagram in FIG. 1. Another embodiment voltage reference circuit is described using FIG. 2. An embodiment compensation circuit is described using FIG. 3. Two embodiment voltage reference circuits are described using FIG. 4 and FIG. 5.

Figure 1:
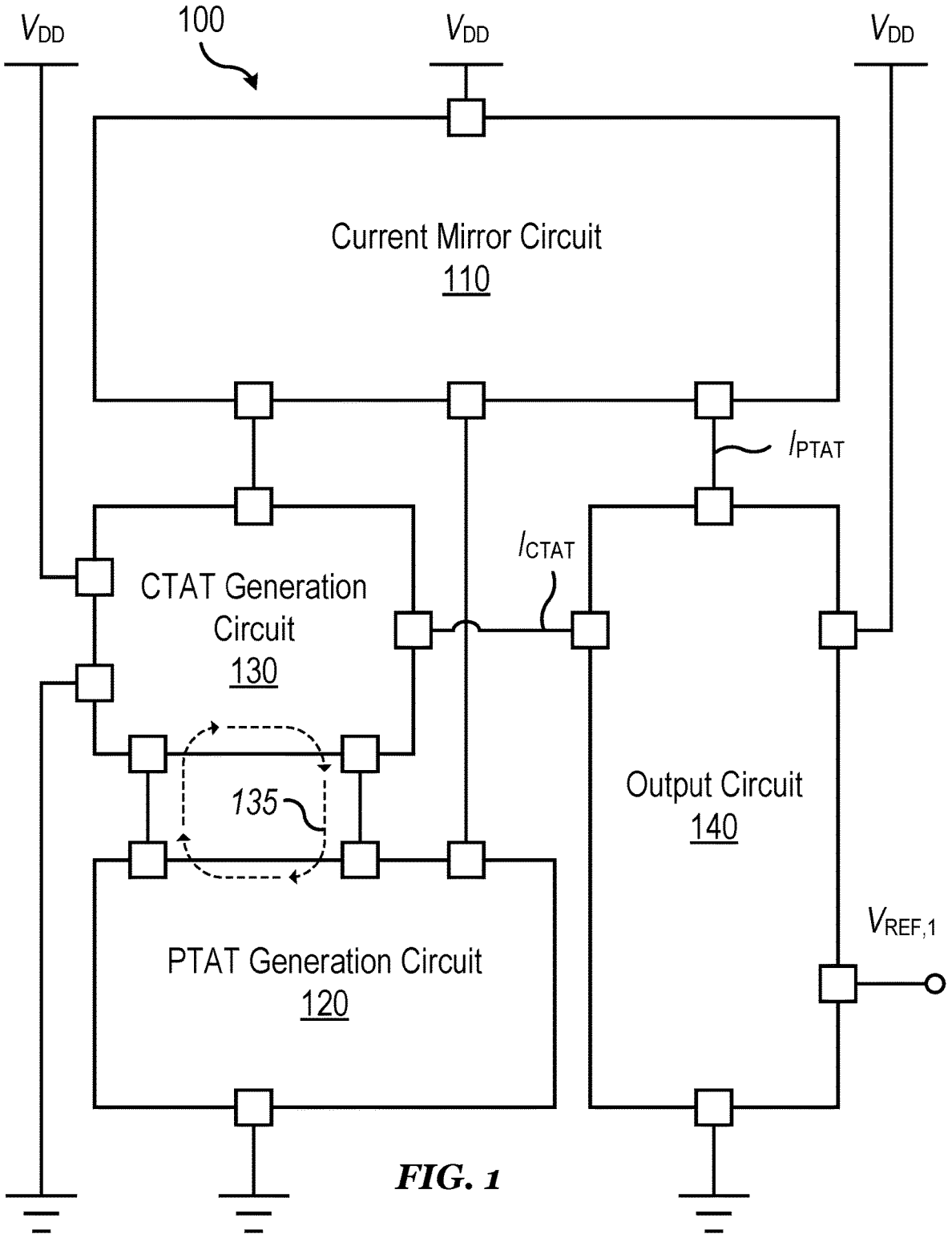
FIG. 1 illustrates a schematic block diagram of an example voltage reference circuit in accordance with an embodiment of the invention.

FIG. 1 illustrates a schematic block diagram of an example voltage reference circuit in accordance with an embodiment of the invention. Although reference is made to circuits in the following, a collection of circuit elements may also be referred to as a circuit block, a module, an electronic device, and the like. Any connections between circuits, to a voltage supply, or to a ground connection as shown in FIG. 1 may represent a single connection or multiple connections. The terms "coupled to" and "connected to" are intended to encompass direct and indirect electrical and/or physical connections between circuit elements.

Referring to FIG. 1, a voltage reference circuit 100 includes a current mirror circuit 110, a PTAT generation circuit 120, a CTAT generation circuit 130, and an output circuit 140. The current mirror circuit no is configured to receive a supply voltage $V_{DD}$ and output three or more currents. In some embodiments, one or more of the currents output by the current mirror circuit 110 are of substantially equal magnitude. Various output currents of the current mirror circuit no may be inverted. The current mirror circuit no may be implemented using transistors. For example, the current mirror circuit 110 may include BJTs or field-effect transistors (FETs). In one embodiment, the current mirror circuit no is implemented using pMOSFETs.

The PTAT generation circuit 120 is configured to generate a PTAT current $I_{PTAT}$ and is coupled to the current mirror circuit 110. The PTAT generation circuit 120 may also be coupled to a ground connection as shown. The PTAT generation circuit 120 may include active and passive devices. For example, active devices may include switching devices, amplifying devices, and the like. Various active devices in the PTAT generation circuit 120 may be implemented using MOSFETs. In other embodiments, the PTAT generation circuit 120 may include other active devices such as BJTs. Passive devices such as resistors, capacitors, inductors, diodes, and others may also be included in the PTAT generation circuit 120. For example, one or more resistors may be used to appropriately scale currents within the PTAT generation circuit 120.

In various embodiments, the PTAT generation circuit 120 comprises a current mirror amplifier. In one embodiment, the PTAT generation circuit 120 comprises a pseudo-Widlar current mirror circuit. For example, the PTAT generation circuit 120 may include a Widlar current mirror circuit implemented using two transistors; one with an aspect ratio that is a multiple of the other. The multiple may be an integer multiple N, for example. In various embodiments, the PTAT generation circuit 120 comprises a FET, and comprises an n-type FET in some embodiments. In one embodiment, the PTAT generation circuit 120 comprises an nMOSFET. In one embodiment, the PTAT generation circuit 120 comprises a pseudo-Widlar current mirror circuit implemented using two nMOSFETS.

The CTAT generation circuit 130 is coupled to the supply voltage $V_{DD}$, the ground connection, and the PTAT generation circuit 120. The CTAT generation circuit 130 is configured to generate a CTAT current $I_{CTAT}$. The CTAT generation circuit 130 may include active and passive devices. In some embodiments, active devices in the CTAT generation circuit 130 are implemented using MOSFETs. In various embodiments, the CTAT generation circuit 130 comprises a FET, and comprises a p-type FET in some embodiments. In one embodiment, the CTAT generation circuit 130 comprises a pMOSFET.

In some embodiments, the CTAT generation circuit 130 comprises an amplifier and, in one embodiment, comprises a common-source amplifier. The CTAT generation circuit 130 may include a multi-stage amplifier. For example, the CTAT generation circuit 130 includes a two-stage amplifier in some embodiments. In one embodiment, the CTAT generation circuit 130 includes a multi-stage common-source amplifier.

In various embodiments, the voltage reference circuit 100 includes a feedback loop 135. For example, the feedback loop 135 may include portions of the PTAT generation circuit 120 and the CTAT generation circuit 130, as shown. The feedback loop 135 may be instrumental in generating the CTAT current $I_{CTAT}$ in the CTAT generation circuit 130. The feedback loop 135 may advantageously increase the stability of the voltage reference circuit 100. For example, the stability of the voltage reference circuit 100 may be increased for a given current consumption rate relative to conventional reference circuits. Further, the stability may advantageously be improved without increasing the start-up time of the voltage reference circuit 100.

The PTAT current $I_{PTAT}$ and the CTAT current $I_{CTAT}$ may be combined at the output circuit 140 which is coupled to the current mirror circuit no and the CTAT generation circuit 130. The output circuit 140 may include active devices such as transistors. In various embodiments, the output circuit 140 includes a FET, and includes a p-type FET in some embodiments. In one embodiment, the output circuit 140 comprises a pMOSFET. The output circuit 140 is further coupled to the supply voltage $V_{DD}$ and the ground connection. A reference voltage $V_{REF,1}$ is provided by the output circuit 140 at an output of the voltage reference circuit 100. The output circuit 140 is configured to combined the PTAT current $I_{PTAT}$ and the CTAT current $I_{CTAT}$ to generated the reference voltage $V_{REF,1}$.

The voltage reference circuit 100 may be advantageously implemented using FETs in several embodiments. For example, all active devices in the voltage reference circuit 100 may be FETs. A possible advantage of excluding BJTs from the voltage reference circuit 100 is reducing the number of process masks used during fabrication of the voltage reference circuit 100. Further, the voltage reference circuit 100 may does not include any operational amplifiers in one embodiment. A possible benefit of excluding operational amplifiers from the voltage reference circuit 100 is improving accuracy of the voltage reference circuit 100.

Figure 2:
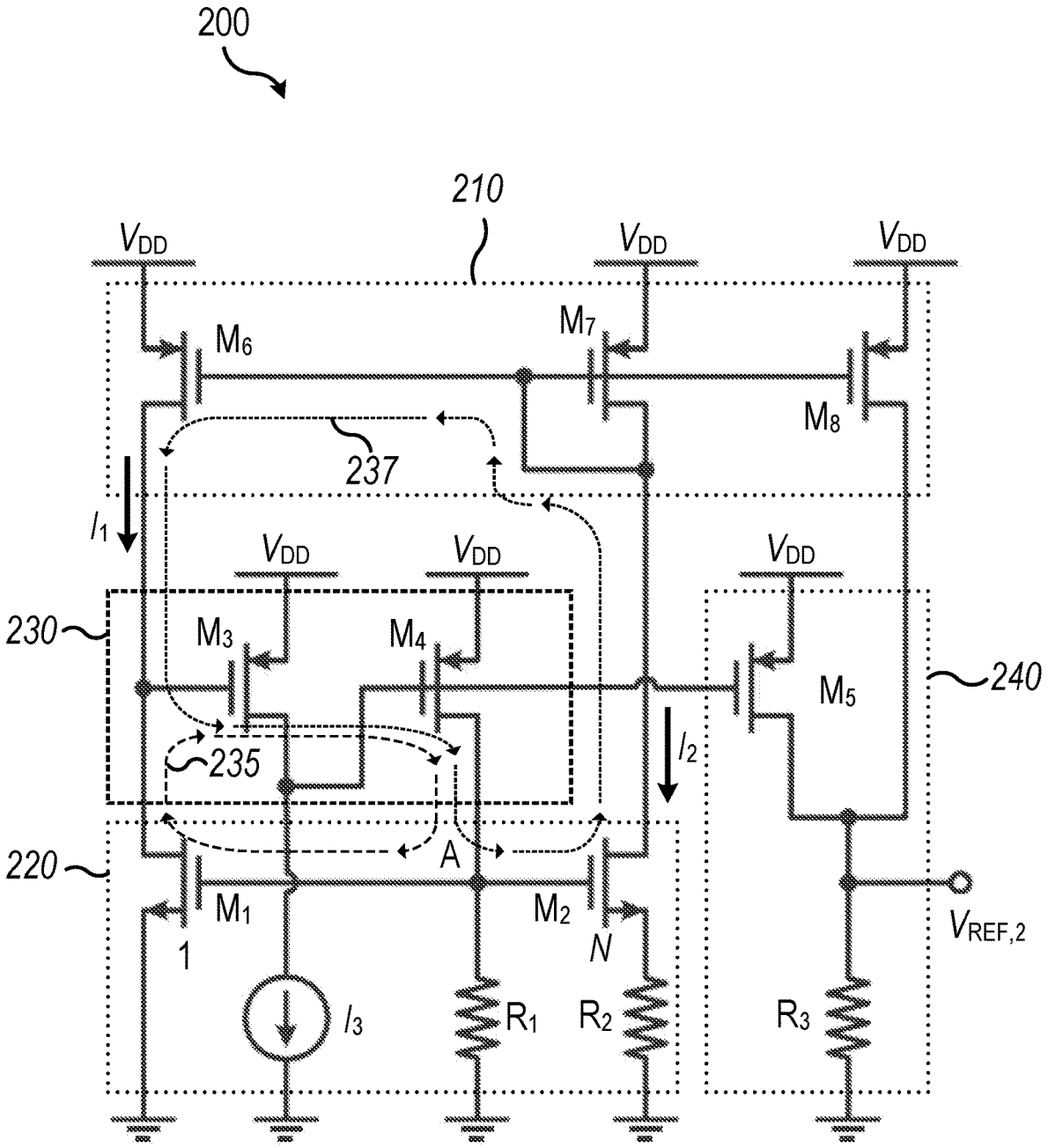
FIG. 2 illustrates a schematic circuit diagram of another example voltage reference circuit in accordance with an embodiment of the invention.

FIG. 2 illustrates a schematic circuit diagram of another example voltage reference circuit in accordance with an embodiment of the invention. The voltage reference circuit of FIG. 2 may be a specific implementation of other embodiment voltage reference circuits such as the voltage reference circuit 100 of FIG. 1 for example.

Referring to FIG. 2, a voltage reference circuit 200 includes a current mirror circuit 210, a PTAT generation circuit 220, a CTAT generation circuit 230, and an output circuit 240 which may be specific implementations of the current mirror circuit 110, the PTAT generation circuit 120, the CTAT generation circuit 130, and the output circuit 140 of FIG. 1 respectively.

The current mirror circuit 210 is implemented using pMOSFETs $M_6$, $M_7$, and $M_8$ which each include a source terminal coupled to a voltage supply $V_{DD}$. The gate terminals of $M_6$, $M_7$, and $M_8$ are all directly coupled while the drain terminals of $M_6$, $M_7$, and $M_8$ provide the current output. $M_6$, $M_7$, and $M_8$ may have substantially identical aspect ratios. Additionally, $M_7$ is connected in a diode configuration (i.e. the gate terminal and the drain terminal of $M_7$ are shorted together). The combination of $M_6$, $M_7$, and $M_8$ form a current mirror circuit which may be thought of as a first current mirror $M_6$-$M_7$ that shares the pMOSFET $M_7$ with a second current mirror $M_7$-$M_8$. As shown, a current L (which is a CTAT current) flows from the drain terminal of $M_6$. A current $I_2$ (which is a PTAT current) flows from the drain terminal of $M_7$.

The PTAT generation circuit 220 is implemented using nMOSFETs $M_1$ and $M_2$ along with resistors $R_1$ and $R_2$. The aspect ratios of $M_1$ and $M_2$ are selected such that the ratio between $M_1$ and $M_2$ is 1:N. In one embodiment, N is an integer greater than 1. The drain terminals of $M_6$ and $M_7$ are further coupled to the drain terminals of $M_1$ and $M_2$ respectively. The gate terminals of $M_1$ and $M_2$ are coupled to the resistor $R_1$ which is connected to a ground connection. The source terminal of $M_1$ is directly coupled to the ground connection while the source terminal of $M_2$ is coupled to the ground connection through the resistor $R_2$.

The CTAT generation circuit 230 is implemented using pMOSFETs $M_3$ and $M_4$ which each include a source terminal coupled to the voltage supply $V_{DD}$. The gate terminal of $M_3$ is coupled to the drain terminals of $M_1$ and $M_6$ while the drain terminal of $M_3$ is coupled to the gate terminal of $M_4$. $M_3$ and $M_4$ may have substantially identical aspect ratios. The drain terminal of $M_4$ is coupled to the gate terminals of $M_1$ and $M_2$ at a node A as shown. Therefore, the CTAT generation circuit 230 is coupled to the current mirror circuit 210 at the gate terminal of $M_3$ and to the PTAT generation circuit 220 at both the gate terminal of $M_3$ and the drain terminal of $M_4$. The drain terminal of $M_3$ and the gate terminal of $M_4$ are further coupled to the ground connection. A current $I_3$ flows to the ground connection which acts as a current sink as shown and may be considered part of the CTAT generation circuit 230. Furthermore, $M_1$ and $R_1$ also contribute to the generation of a CTAT current by virtue of a first feedback loop 235, as shown.

The output circuit 240 is implemented using a pMOSFET $M_5$ and a resistor $R_3$. The source terminal of $M_5$ is coupled to the voltage supply $V_{DD}$ and the gate terminal of $M_5$ is coupled to the gate terminal of $M_4$. Meanwhile, the drain terminal of $M_5$ is coupled to the drain terminal of $M_8$ which combines the PTAT current and the CTAT current to generate a reference voltage $V_{REF,2}$ at an output of the voltage reference circuit 200. The resistor $R_3$ may function at the output similar to a pull-down resistor and is coupled to the ground connection and the drain terminals of $M_5$ and $M_8$.

The voltage reference circuit 200 is a current mode circuit and may include the advantages of conventional current mode reference circuits. Additionally, the voltage reference circuit 200 is autopolarized (i.e. does not require an operational amplifier), and therefore is beneficially a low voltage solution. Furthermore, the introduction of a low complexity feedback circuit advantageously allows improved stability performance versus current consumption without compromising the start-up time.

Rather than using common-drain transistor as in some conventional reference circuits, a two-stage common-source amplifier (i.e. $M_3$-$M_4$) is incorporated in the voltage reference circuit 200. The two inverting stages generate negative feedback via the first feedback loop 235 which may be a specific implementation of feedback loop 135 of FIG. 1. Additionally, the two inverting stages also provide a low-complexity solution for Widlar mirror biasing. The PTAT current is then $$I_2 = \frac{V_{GS1} - V_{GS2}}{R_2} = \frac{V_T}{R_2}\ln(N) \tag{8}$$

At the same time, the feedback produces a CTAT current as $$I_1 = \frac{V_{GS1}}{R_1} \tag{9}$$

These currents are combined at the output as $$V_{REF,2} = \frac{R_3}{R_1}V_{GS1} + \frac{R_3}{R_2}V_T\ \ln(N) \tag{10}$$

Figure 4:
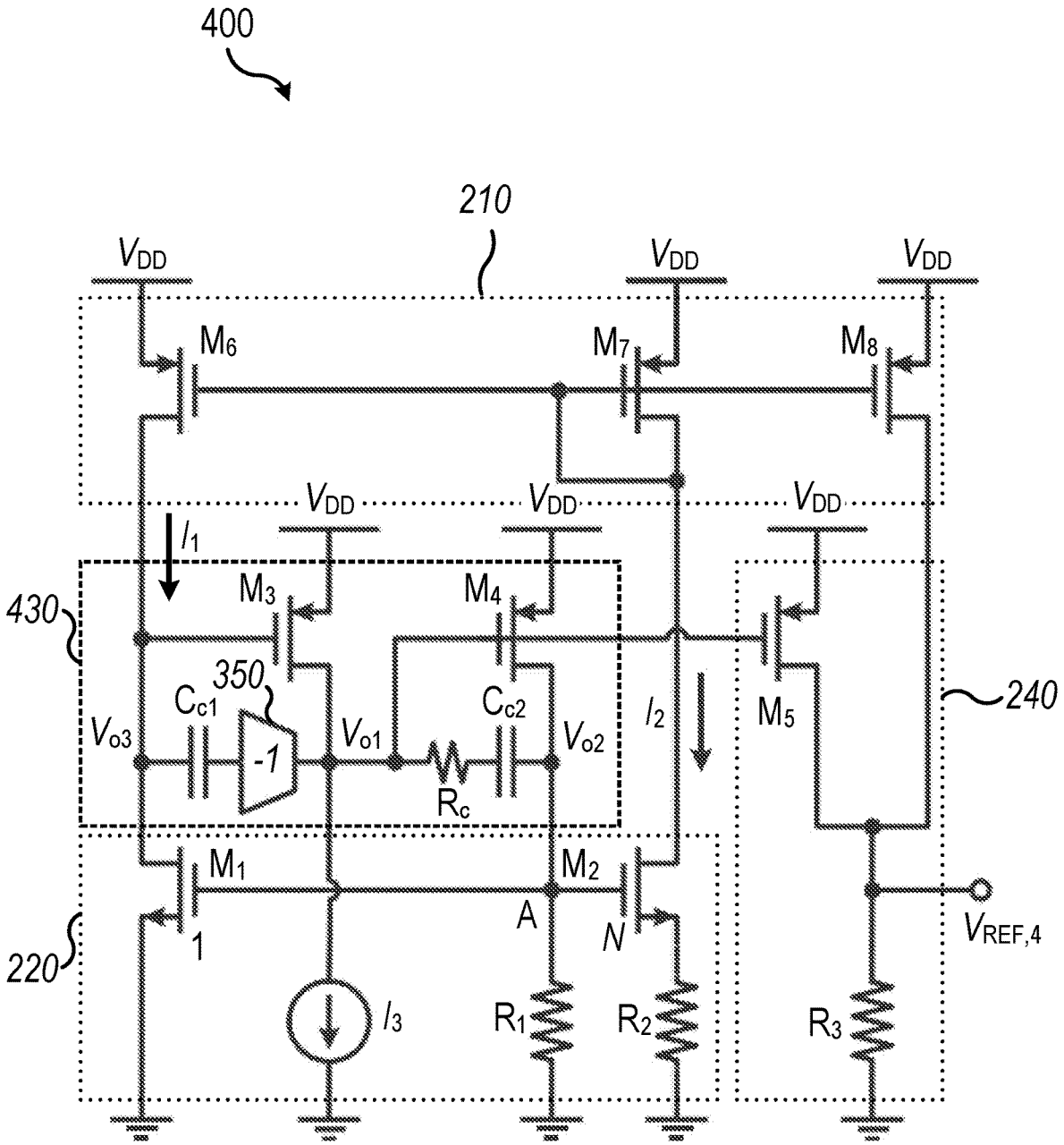
FIG. 4 illustrates a schematic circuit diagram of still another example voltage reference circuit in accordance with an embodiment of the invention.
Figure 5:
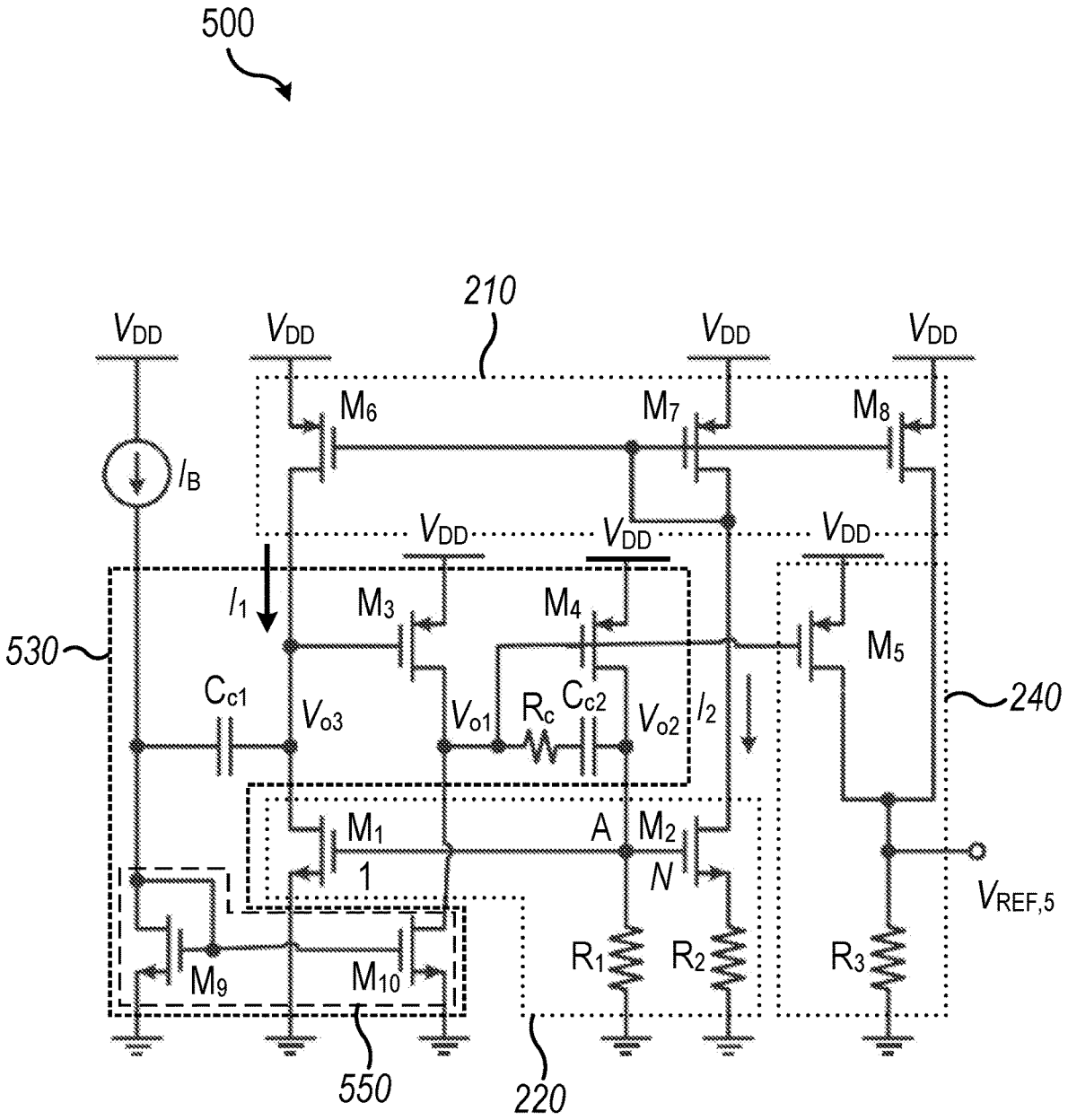
FIG. 5 illustrates a schematic circuit diagram of yet another example voltage reference circuit in accordance with an embodiment of the invention.

The voltage reference circuit 200 includes two feedback loops: a three-stage negative feedback loop (the first feedback loop 235) and a four-stage positive feedback loop (a second feedback loop 237). The four-stage positive feedback loop may be negligible and the stability of the voltage reference circuit 200 may be improved using a reverse nested Miller technique as shown in FIGS. 3-5 below.

Figure 3:
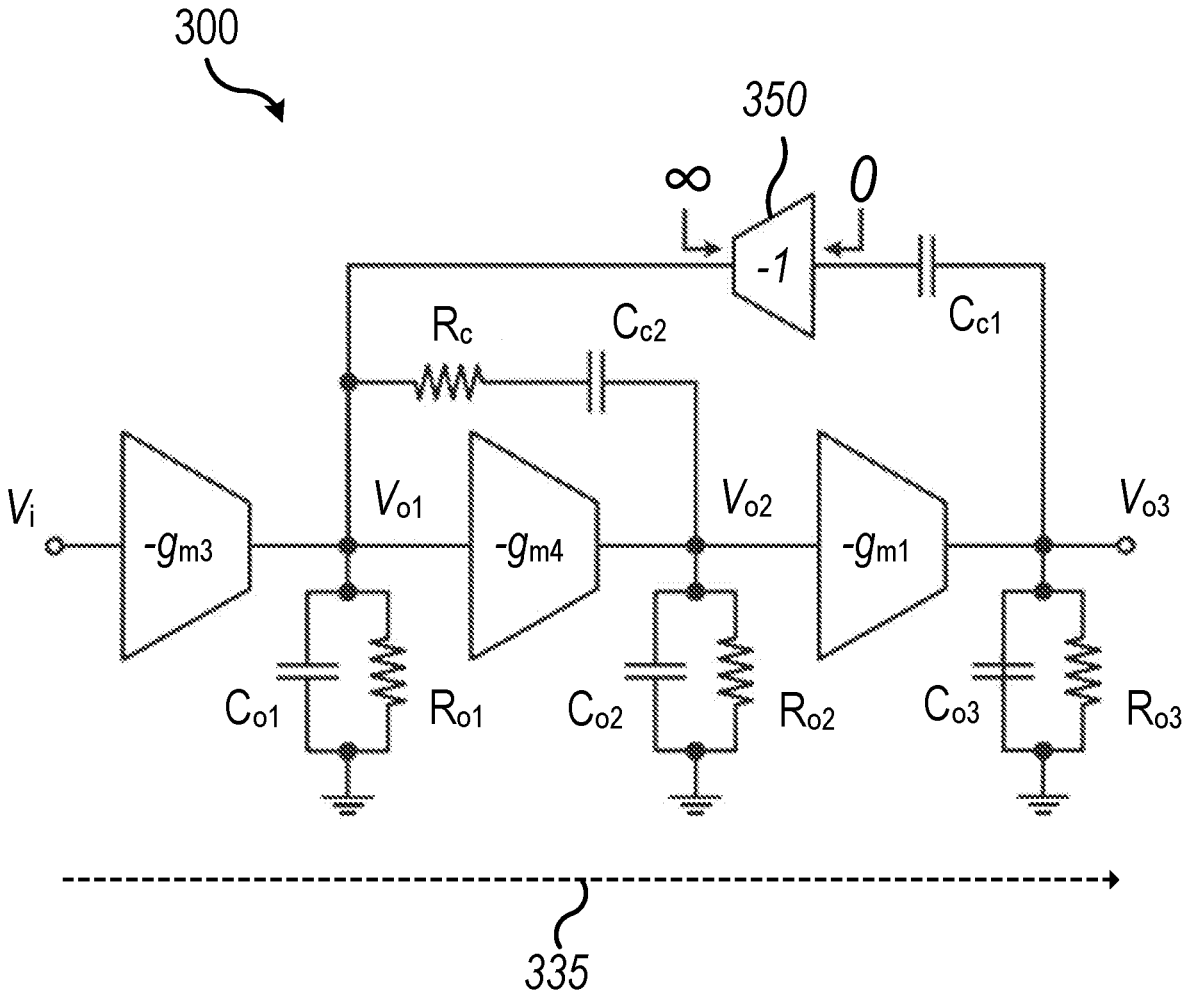
FIG. 3 illustrates a schematic block diagram of an example compensation circuit in accordance with an embodiment of the invention.

FIG. 3 illustrates a schematic block diagram of an example compensation circuit in accordance with an embodiment of the invention. Principles of the compensation circuit of FIG. 3 may be used to implement feedback compensation in embodiment voltage reference circuits such as the voltage reference circuit 200 of FIG. 2, for example.

Referring to FIG. 3, a compensation circuit 300 includes a feedback loop 335 (shown straightened out) which may be similar to other feedback loops such as feedback loop 225, for example. The compensation circuit 300 includes an input node $V_i$ and three output nodes $V_{01}$, $V_{02}$, and $V_{03}$ after each of three stages having transconductances of $-g_{m3}$, $-g_{m4}$, and $-g_{m1}$ as shown. The nodes $V_{01}$, $V_{02}$, and $V_{03}$ may be connected to a ground connection through respective resistor-capacitor (RC) circuits each including a capacitor in parallel with a resistor (i.e. $C_{01}$-$R_{01}$, $C_{02}$-$R_{02}$, and $C_{03}$-$R_{03}$ as illustrated).

A first compensation stage is coupled between $V_{01}$ and $V_{03}$ and includes an inversion stage 350 and in series with a capacitor $C_{c1}$. A second compensation stage is coupled between $V_{01}$ and $V_{02}$ and includes a resistor $R_c$ in series with a capacitor $C_{c2}$. The first and second compensation stages are configured to increase stability of the feedback loop 335. The principle of the reverse nested Miller technique shown in compensation circuit 300 can be combined with embodiment voltage reference circuits (e.g. the voltage reference circuit 200 of FIG. 2) to advantageously improve stability as shown in FIG. 4 and FIG. 5.

FIG. 4 illustrates a schematic circuit diagram of yet another example voltage reference circuit in accordance with an embodiment of the invention. The voltage reference circuit of FIG. 4 may be a specific implementation of other embodiment voltage reference circuits such as the voltage reference circuit 100 of FIG. 1, for example. Similarly labeled elements may be as previously described.

Referring to FIG. 4, a voltage reference circuit 400 includes a current mirror circuit 210, a PTAT generation circuit 220, and an output circuit 240 each of which may be as previously described. The voltage reference circuit 400 also includes a CTAT generation circuit 430 including two pMOSFETs $M_3$ and $M_4$ which may be as previously described. As before, a current $I_3$, transistor $M_1$, and resistor $R_1$ also contribute to the generation of a CTAT current by virtue of a feedback loop. The CTAT generation circuit 430 may be a specific implementation of other CTAT generation circuits, such as the CTAT generation circuit 130 of FIG. 1, for example. The voltage reference circuit 400 produces a reference voltage $V_{REF,4}$ at an output of the output circuit 240 which is an output of the voltage reference circuit 400.

Nodes $V_{01}$, $V_{02}$, and $V_{03}$ are labeled in a similar manner as corresponding nodes of the compensation circuit 300 to illustrate application of the principle of the reverse nested Miller technique in the voltage reference circuit 400. For example, the CTAT generation circuit 430 further includes an inversion stage 350 and a capacitor $C_{c1}$ coupled between nodes $V_{01}$ and $V_{03}$. A resistor $R_c$ and a capacitor $C_{c2}$ are also included in the CTAT generation circuit 430 coupled between nodes $V_{01}$ and $V_{02}$. The inversion stage 350, $R_c$, $C_{c1}$, and $C_{c2}$ may be as previously described.

One implementation of an inversion stage in a feedback loop of an embodiment voltage reference circuit is shown below in FIG. 5, which illustrates a schematic circuit diagram of still another example voltage reference circuit in accordance with an embodiment of the invention.

Referring to FIG. 5, a voltage reference circuit 500 includes a current mirror circuit 210, a PTAT generation circuit 220, and an output circuit 240 each of which may be as previously described. The voltage reference circuit 500 also includes a CTAT generation circuit 530 including two pMOSFETs $M_3$ and $M_4$ which may be as previously described. As before, transistor $M_1$, and resistor $R_1$ also contribute to the generation of a CTAT current by virtue of a feedback loop. The CTAT generation circuit 530 may be a specific implementation of other CTAT generation circuits, such as the CTAT generation circuit 130 of FIG. 1, for example. The voltage reference circuit 500 produces a reference voltage $V_{REF,5}$ at an output of the output circuit 240 which is an output of the voltage reference circuit 500.

As before, nodes $V_{01}$, $V_{02}$, and $V_{03}$ are labeled in a similar manner as corresponding nodes of the compensation circuit 300 to illustrate application of the principle of the reverse nested Miller technique in the voltage reference circuit 500. For example, the CTAT generation circuit 530 further includes an inversion stage 550 and a capacitor $C_{c1}$ coupled between nodes $V_{o1}$ and $V_{03}$. A resistor $R_c$ and a capacitor $C_{c2}$ are also included in the CTAT generation circuit 530 coupled between nodes $V_{01}$ and $V_{01}$. $R_c$, $C_{c1}$, and $C_{c2}$ may be as previously described.

The inversion stage 550 includes a pair of nMOSFETs $M_9$ and $M_{10}$. The gate terminals of $M_9$ and $M_{10}$ are coupled together while the source terminals of $M_9$ and $M_{10}$ are coupled to a ground connection. Additionally, $M_9$ is connected in a diode configuration (i.e. the gate terminal and the drain terminal of $M_9$ are shorted together). The current supply $I_B$ to the current mirror $M_9$-$M_{10}$ may advantageously offer a simple solution to start-up the voltage reference circuit 500.

Advantageously, the voltage supply $V_{DD}$ of embodiment voltage reference circuits may be lower than conventional reference circuits. In various embodiments, the voltage supply $V_{DD}$ is between 1 V and 3.5 V. In one embodiment, the voltage supply $V_{DD}$ is about 1.2 V. In another embodiment, the voltage supply $V_{DD}$ is about 3.3 V. However, the voltage supply $V_{DD}$ may also be lower than 1 V or higher than 3.5 V depending on the specific needs of a particular application.

Another possible benefit of embodiment voltage reference circuits is reduced power consumption relative to conventional reference circuits. For example, the power consumption of embodiment voltage reference circuits may be on the order of hundreds of nanowatts. In various embodiments, the power consumption is between 0.5 μW and 1 μW. In some embodiments, the power consumption is between 0.6 μW and 0.7 μW and is about 0.64 μW in one embodiment. For example, an embodiment voltage reference circuit may have a power consumption of 0.64 μW and produce a reference voltage of 600 mV. However, other power consumption values are possible.

Embodiment voltage reference circuits may advantageously be compatible with CMOS fabrication processes. For example, an embodiment voltage reference circuit may be implemented using 130 nm CMOS technology. In cases where no operational amplifiers or BJTs are included an embodiment voltage reference circuit, robustness with respect to fabrication processes may be achieved without additional masking steps. As an example, a process accuracy of 8% may be achieved.

A further advantage of embodiment voltage reference circuits may be a lower temperature coefficient compared to conventional reference circuits. In various embodiments, the temperature coefficient is between $1_5$ ppm and 25 ppm. In one embodiment, the temperature coefficient is about 19 ppm.

The embodiment voltage reference circuits described herein may also exhibit other advantageous properties in combination with the above potential advantages when compared to conventional reference circuits. For example, embodiment reference circuits may have a power supply rejection ratio (PSRR) of about −56 dB at 10 Hz. Further, the line sensitivity percentage of embodiment reference circuits may between 0.3%/V and 0.5%/V, such as about 0.43%/V, for example.

The possible benefits of the embodiment voltage reference circuits described herein may be achieved over a range of temperatures that are advantageously suitable for a variety of applications. In various embodiments, desirable operation of embodiment reference circuits is achieved in the temperature range of −40° C. to 85° C. However, in some embodiments, the embodiment voltage reference circuits may maintain desirable operation outside of this range. For example, the temperature range may be extended below −40° C. and/or above 85° C., such as to a temperature of 100° C. or more.

Example embodiments of the invention are summarized here. Other embodiments can also be understood from the entirety of the specification as well as the claims filed herein.

Example 1

A voltage reference circuit including: a first circuit block configured to generate a PTAT current, the first circuit block including a current mirror amplifier; a second circuit block coupled to the first circuit block and configured to generated a CTAT current, the second circuit block including a multi-stage common-source amplifier; and a third circuit block coupled to both the first circuit block and the second circuit block, wherein the third circuit block is configured to combine the PTAT current and the CTAT current to generate a reference voltage at an output of the voltage reference circuit.

Example 2

The voltage reference circuit of example 1, further including: a fourth circuit block coupled to the first circuit block, the second circuit block, and the third circuit block, wherein the fourth circuit block is configured to receive a voltage supply and provide a current to each of the first circuit block, the second circuit block, and the third circuit block.

Example 3

The voltage reference circuit of one of examples 1 and 2, wherein the multi-stage common-source amplifier includes exactly two pMOSFETs that are each connected in a common-source configuration.

Example 4

The voltage reference circuit of one of examples 1 to 3, wherein the current mirror amplifier includes a first nMOSFET and a second nMOSFET, wherein an aspect ratio of the second nMOSFET is greater than an aspect ratio of the first nMOSFET by a factor of N, and wherein N is an integer greater than 1.

Example 5

The voltage reference circuit of one of examples 1 to 4, further including: a three-stage feedback loop that includes portions of the first circuit block and the second circuit block, wherein the three-stage feedback loop contributes to generation of the CTAT current.

Example 6

The voltage reference circuit of example 5, wherein the three-stage feedback loop is compensated using a reverse nested Miller technique.

Example 7

The voltage reference circuit of one of examples 1 to 6, wherein all active devices in the voltage reference circuit are FETs; and wherein the voltage reference circuit does not include any operational amplifiers.

Example 8

A voltage reference circuit including: a PTAT generation circuit configured to generate a PTAT current; a CTAT generation circuit configured to generate a CTAT current; an output circuit configured to combine the PTAT current and the CTAT current to generate a reference voltage at an output of the voltage reference circuit; and wherein the CTAT generation circuit includes a first p-type FET having a source terminal coupled to a voltage supply, a gate terminal coupled to a ground connection at a first node, and a drain terminal coupled to the PTAT generation circuit and the ground connection at a second node, and a second p-type FET having a source terminal coupled to the voltage supply, a gate terminal coupled to the PTAT generation circuit at a third node, and a drain terminal coupled to the ground connection at the first node.

Example 9

The voltage reference circuit of example 8, wherein the CTAT generation circuit further includes: a first compensation stage coupled between the first node and the second node, the first compensation stage including a resistor in series with a first capacitor; and a second compensation stage coupled between the first node and the third node, the second compensation stage including an inversion stage in series with a second capacitor.

Example 10

The voltage reference circuit of example 9, wherein the inversion stage includes a current mirror including: a first n-type FET having a source terminal coupled to the ground connection, a drain terminal coupled to the first node, and a gate terminal; a second n-type FET having a source terminal coupled to the ground connection, a drain terminal coupled to the second capacitor and the voltage supply, and a gate terminal coupled the gate terminal of the first n-type FET; and wherein the drain and gate terminals of the second n-type FET are shorted together so that the second n-type FET is connected in a diode configuration between the second capacitor and the first n-type FET.

Example 11

The voltage reference circuit of one of examples 8 to 10, further including a current mirror circuit including: a first transistor having a drain terminal coupled to the third node; a second transistor having a drain terminal coupled to the PTAT circuit; a third transistor having a drain terminal coupled to the output circuit; wherein source terminals of the first, second, and third transistors are coupled to the voltage supply; wherein gate terminals of the first, second, and third transistors are coupled together; and wherein the drain and gate terminals of the second transistor are shorted together so that the second transistor is connected in a diode configuration between the voltage supply and the PTAT generation circuit.

Example 12

The voltage reference circuit of one of examples 8 to 11, wherein: the drain terminal of the first p-type FET is connected to the ground connection through a first resistor configured to scale the CTAT current; and the PTAT generation circuit is coupled to the ground connection through a second resistor configured to scale the PTAT current.

Example 13

The voltage reference circuit of one of examples 8 to 12, wherein the PTAT circuit includes: a first n-type FET having a source terminal coupled to the ground connection, a drain terminal coupled to the third node, and a gate terminal coupled to the second node; a second n-type FET having a source terminal coupled to the ground connection and a gate terminal coupled to the second node; and wherein an aspect ratio of the second n-type FET is greater than an aspect ratio of the first n-type FET by a factor of N, and wherein N is an integer greater than 1.

Example 14

The voltage reference circuit of one of examples 8 to 13, wherein all active devices in the voltage reference circuit are FETs; and wherein the voltage reference circuit does not include any operational amplifiers.

Example 15

A voltage reference circuit including: a current mirror circuit coupled to a voltage supply; a PTAT generation circuit coupled to the current mirror circuit and to a ground connection; a CTAT generation circuit coupled to the voltage supply, the current mirror circuit, the PTAT generation circuit, and the ground connection; an output circuit coupled to the voltage supply, the current mirror circuit, the CTAT generation circuit, and the ground connection; wherein all active devices in the voltage reference circuit are FETs; and wherein the voltage reference circuit does not include any operational amplifiers.

Example 16

The voltage reference circuit of example 15, wherein the CTAT generation circuit includes: a two-stage common-source amplifier coupled between the PTAT generation circuit and the output circuit, the two-stage common-source amplifier including exactly two FETs that are each connected in a common-source configuration.

Example 17

The voltage reference circuit of example 16, wherein the CTAT generation circuit further includes: a compensation stage coupled between a first FET of the two-stage common-source amplifier and a second FET of the two-stage common-source amplifier, the compensation stage including an inversion stage in series with a capacitor.

Example 18

The voltage reference circuit of one of examples 15 to 17, wherein the PTAT generation circuit includes: a current mirror amplifier coupled between the current mirror circuit and the CTAT generation circuit, the current mirror amplifier including a first FET and a second FET, wherein an aspect ratio of the second FET is greater than an aspect ratio of the first FET by a factor of N, and wherein N is an integer greater than 1.

Example 19

The voltage reference circuit of one of examples 15 to 18, wherein: the CTAT generation circuit includes a two-stage common-source amplifier coupled between the PTAT generation circuit and the output circuit, the two-stage common-source amplifier including exactly two FETs that are each connected in a common-source configuration; and the PTAT generation circuit includes a current mirror amplifier coupled between the current mirror circuit and the CTAT generation circuit, the current mirror amplifier including a first FET and a second FET, wherein an aspect ratio of the second FET is greater than an aspect ratio of the first FET by a factor of N, and wherein N is an integer greater than 1.

Example 20

The voltage reference circuit of one of examples 15 to 19, wherein all FETs in the voltage reference circuit are MOSFETs.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. For example, one or more of the embodiments of FIGS. 1-5 may be combined in further embodiments. It is therefore intended that the appended claims encompass any such modifications or embodiments.

What is claimed is:

1. A voltage reference circuit comprising:

a first circuit block configured to generate a proportional to absolute temperature (PTAT) current, the first circuit block comprising a current mirror amplifier;

a second circuit block coupled to the first circuit block and configured to generated a complimentary to absolute temperature (CTAT) current, the second circuit block comprising a multi-stage common-source amplifier;

a third circuit block coupled to both the first circuit block and the second circuit block, wherein the third circuit block is configured to combine the PTAT current and the CTAT current to generate a reference voltage at an output of the voltage reference circuit; and a feedback loop that includes portions of the first circuit block and the second circuit block, wherein the feedback loop contributes to generation of the CTAT current.

2. The voltage reference circuit of claim 1, further comprising:

a fourth circuit block coupled to the first circuit block, the second circuit block, and the third circuit block, wherein the fourth circuit block is configured to receive a voltage supply and provide a current to each of the first circuit block, the second circuit block, and the third circuit block.

3. The voltage reference circuit of claim 1, wherein the multi-stage common-source amplifier comprises exactly two p-type metal-oxide-semiconductor field-effect transistors (pMOSFETs) that are each connected in a common-source configuration.

4. The voltage reference circuit of claim 1, wherein the current mirror amplifier comprises a first n-type metal-oxide-semiconductor field-effect transistor (nMOSFET) and a second nMOSFET, wherein an aspect ratio of the second nMOSFET is greater than an aspect ratio of the first nMOSFET by a factor of N, and wherein N is an integer greater than 1.

5. The voltage reference circuit of claim 1, wherein the feedback loop is a three-stage feedback loop comprising one stage in the first circuit block and two stages in the second circuit block.

6. The voltage reference circuit of claim 5, wherein the three-stage feedback loop is compensated using a reverse nested Miller technique.

7. The voltage reference circuit of claim 1, wherein all active devices in the voltage reference circuit are field-effect transistors (FETs); and wherein the voltage reference circuit does not include any operational amplifiers.

8. A voltage reference circuit comprising:

a proportional to absolute temperature (PTAT) generation circuit configured to generate a PTAT current;

a complimentary to absolute temperature (CTAT) generation circuit configured to generate a CTAT current;

an output circuit configured to combine the PTAT current and the CTAT current to generate a reference voltage at an output of the voltage reference circuit; and wherein the CTAT generation circuit comprises a first p-type field-effect transistor (FET) having a source terminal coupled to a voltage supply, a gate terminal coupled to a ground connection at a first node, and a drain terminal coupled to the PTAT generation circuit and the ground connection at a second node, and a second p-type FET having a source terminal coupled to the voltage supply, a gate terminal coupled to the PTAT generation circuit at a third node, and a drain terminal coupled to the ground connection at the first node.

9. The voltage reference circuit of claim 8, wherein the CTAT generation circuit further comprises:

a first compensation stage coupled between the first node and the second node, the first compensation stage comprising a resistor in series with a first capacitor; and a second compensation stage coupled between the first node and the third node, the second compensation stage comprising an inversion stage in series with a second capacitor.

10. The voltage reference circuit of claim 9, wherein the inversion stage comprises a current mirror comprising:

a first n-type FET having a source terminal coupled to the ground connection, a drain terminal coupled to the first node, and a gate terminal;

a second n-type FET having a source terminal coupled to the ground connection, a drain terminal coupled to the second capacitor and the voltage supply, and a gate terminal coupled the gate terminal of the first n-type FET; and wherein the drain and gate terminals of the second n-type FET are shorted together so that the second n-type FET is connected in a diode configuration between the second capacitor and the first n-type FET.

11. The voltage reference circuit of claim 8, further comprising a current mirror circuit comprising:

a first transistor having a drain terminal coupled to the third node;

a second transistor having a drain terminal coupled to the PTAT circuit;

a third transistor having a drain terminal coupled to the output circuit;

wherein source terminals of the first, second, and third transistors are coupled to the voltage supply;

wherein gate terminals of the first, second, and third transistors are coupled together; and wherein the drain and gate terminals of the second transistor are shorted together so that the second transistor is connected in a diode configuration between the voltage supply and the PTAT generation circuit.

12. The voltage reference circuit of claim 8, wherein:

the drain terminal of the first p-type FET is connected to the ground connection through a first resistor configured to scale the CTAT current; and the PTAT generation circuit is coupled to the ground connection through a second resistor configured to scale the PTAT current.

13. The voltage reference circuit of claim 8, wherein the PTAT circuit comprises:

a first n-type FET having a source terminal coupled to the ground connection, a drain terminal coupled to the third node, and a gate terminal coupled to the second node;

a second n-type FET having a source terminal coupled to the ground connection and a gate terminal coupled to the second node; and wherein an aspect ratio of the second n-type FET is greater than an aspect ratio of the first n-type FET by a factor of N, and wherein Nis an integer greater than 1.

14. The voltage reference circuit of claim 8, wherein all active devices in the voltage reference circuit are field-effect transistors (FETs); and wherein the voltage reference circuit does not include any operational amplifiers.

15. A voltage reference circuit comprising:

a current mirror circuit coupled to a voltage supply;

a proportional to absolute temperature (PTAT) generation circuit coupled to the current mirror circuit and to a ground connection;

a complementary to absolute temperature (CTAT) generation circuit coupled to the voltage supply, the current mirror circuit, the PTAT generation circuit, and the ground connection;

an output circuit coupled to the voltage supply, the current mirror circuit, the CTAT generation circuit, and the ground connection;

a feedback loop that includes portions of the PTAT generation circuit and the CTAT generation circuit, wherein the feedback loop contributes to generation of a CTAT current;

wherein all active devices in the voltage reference circuit are field-effect transistors (FETs); and wherein the voltage reference circuit does not include any operational amplifiers.

16. The voltage reference circuit of claim 15, wherein the CTAT generation circuit comprises:

a two-stage common-source amplifier coupled between the PTAT generation circuit and the output circuit, the two-stage common-source amplifier comprising exactly two FETs that are each connected in a common-source configuration.

17. The voltage reference circuit of claim 16, wherein the CTAT generation circuit further comprises:

a compensation stage coupled between a first FET of the two-stage common-source amplifier and a second FET of the two-stage common-source amplifier, the compensation stage comprising an inversion stage in series with a capacitor.

18. The voltage reference circuit of claim 15, wherein the PTAT generation circuit comprises:

a current mirror amplifier coupled between the current mirror circuit and the CTAT generation circuit, the current mirror amplifier comprising a first FET and a second FET, wherein an aspect ratio of the second FET is greater than an aspect ratio of the first FET by a factor of N, and wherein Nis an integer greater than 1.

19. The voltage reference circuit of claim 15, wherein:

the CTAT generation circuit comprises a two-stage common-source amplifier coupled between the PTAT generation circuit and the output circuit, the two-stage common-source amplifier comprising exactly two FETs that are each connected in a common-source configuration; and the PTAT generation circuit comprises a current mirror amplifier coupled between the current mirror circuit and the CTAT generation circuit, the current mirror amplifier comprising a first FET and a second FET, wherein an aspect ratio of the second FET is greater than an aspect ratio of the first FET by a factor of N, and wherein N is an integer greater than 1.

20. The voltage reference circuit of claim 15, wherein all FETs in the voltage reference circuit are metal-oxide-semiconductor FETs (MOSFETs).

* * * * *